US006722498B2

(12) United States Patent
Westfield et al.

(10) Patent No.: US 6,722,498 B2
(45) Date of Patent: Apr. 20, 2004

(54) INTEGRATED STORAGE CONTAINER FOR AN ATTACHMENT TO A PERSONAL GROOMING TOOL

(75) Inventors: Barbara Westfield, Chicago, IL (US); Philippe Starck, Paris (FR)

(73) Assignee: Salton, Inc., Lake Forest, IL (US)

( * ) Notice: Subject to any disclaimer, the term of this patent is extended or adjusted under 35 U.S.C. 154(b) by 0 days.

(21) Appl. No.: 10/068,325

(22) Filed: Feb. 6, 2002

(65) Prior Publication Data

US 2003/0146122 A1 Aug. 7, 2003

(51) Int. Cl.[7] ..... A45C 11/26; A45D 44/18; B65D 71/00; B65D 69/00

(52) U.S. Cl. ..... 206/349; 206/15.2; 206/228; 206/576; 206/581

(58) Field of Search ..... 206/349, 351, 206/320, 15.2, 228, 361, 362, 38, 576, 581, 486, 379, 372, 373, 375; 320/114, 115; 248/346.03; 211/69, 70.6; 132/308, 289, 314, 215, 223, 271

(56) References Cited

U.S. PATENT DOCUMENTS

| | | | | | |
|---|---|---|---|---|---|
| 2,540,841 | A | | 2/1951 | Stancu | |
| 2,608,294 | A | | 8/1952 | Ward | |
| 2,756,793 | A | * | 7/1956 | Tupper | 220/805 |
| 2,926,779 | A | * | 3/1960 | Jepson | 206/351 |
| 2,956,851 | A | | 10/1960 | Merendino | |
| 3,141,712 | A | | 7/1964 | Holmes et al. | |
| 3,143,697 | A | | 8/1964 | Springer | |
| 3,194,621 | A | | 7/1965 | Frost | |
| 3,281,636 | A | | 10/1966 | Fleckenstein et al. | |
| 3,287,076 | A | | 11/1966 | Spofford | |
| 3,371,260 | A | | 2/1968 | Jackson et al. | |
| 3,463,994 | A | * | 8/1969 | Spohr | 320/115 |
| 3,609,501 | A | * | 9/1971 | Ray et al. | 206/228 |
| 4,817,826 | A | | 4/1989 | Judge | |
| 5,033,617 | A | | 7/1991 | Hartwein et al. | |
| 5,566,596 | A | * | 10/1996 | Lin | 81/490 |
| 5,566,823 | A | | 10/1996 | Summers | |
| 5,617,884 | A | * | 4/1997 | Allison | 211/65 |
| 5,725,091 | A | | 3/1998 | Knoebel | |
| 6,415,517 | B1 | * | 7/2002 | Worrick, III | 206/228 |

* cited by examiner

*Primary Examiner*—Mickey Yu
*Assistant Examiner*—Gregory Pickett
(74) *Attorney, Agent, or Firm*—Sonnenschein Nath & Rosenthal

(57) ABSTRACT

The present invention relates to a storage container for an attachment to a personal grooming tool. The container includes a housing and a cover. The housing includes a chamber configured to store the attachments. The cover is configured to fit over the housing to enclose the chamber. The cover also includes a cavity designed to support the tool.

8 Claims, 6 Drawing Sheets

INTEGRATED STORAGE CONTAINER FOR AN ATTACHMENT TO A PERSONAL GROOMING TOOL

FIELD OF THE INVENTION

The present invention relates generally to a storage container and more specifically to an integrated storage container for an attachment to a personal grooming tool.

BACKGROUND OF THE INVENTION

Personal grooming tools generally have a plurality of attachments to allow a user to use the same handle with a variety of attachments. For example, a curling iron may include a spiral attachment or a brush sleeve attachment to accommodate various curling styles. Hair dryers may include attachments such as a diffuser or various brush attachments. Also, a beard trimmer may include various attachments to allow for different trimming lengths or to allow the user to replace a dull blade. An electric toothbrush typically includes a replaceable attachment to accommodate multiple users or to allow the user to replace the toothbrush head without discarding the entire device.

Most conventional personal grooming tools do not include a storage container for the attachments. In some cases when the personal grooming tool is battery-operated and includes a rechargeable battery, the charger for the tool may be implemented in a base with a rack to accommodate the attachments. One disadvantage to the racks is that they tend to be bulky and occupy additional space.

SUMMARY OF THE INVENTION

In accordance with the present invention, an integrated storage container is provided for attachments to a personal grooming tool that includes a stand for the base. The storage container utilizes minimal space and includes a housing and a cover. The housing has a chamber configured to store an attachment for a personal grooming tool. The cover is configured to fit over the housing to enclose the chamber. The cover also includes a cavity designed to support the tool.

In accordance with the present invention, an integrated storage container is provided for attachments to a personal grooming tool that includes a stand for the base. The storage container utilizes minimal space and includes a housing and a cover. The housing includes a support for an attachment to a personal grooming tool and a cavity. The cavity is designed to support the tool. The cover is configured to fit over the housing and includes an aperture positioned to overlap the cavity when the cover is placed on the housing.

In accordance with the present invention, an article of manufacture is provided. The article comprises a personal grooming tool, an attachment, a housing, and a cover. The attachment is connected to the personal grooming tool and is detachable from the personal grooming tool. The housing has a chamber configured to store the attachment. The cover is configured to fit over the housing to enclose the chamber, and the cover includes a cavity designed to support the tool.

In accordance with the present invention, an article of manufacture is provided. The article comprises a personal grooming tool, an attachment, a housing, and a cover. The attachment is connected to the personal grooming tool and is detachable from the personal grooming tool. The housing includes a support for the attachment and a cavity. The cavity is designed to support the tool. The cover is configured to fit over the housing and includes an aperture positioned to overlap the cavity when the cover is placed on the housing.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The accompanying drawings, which are incorporated in and constitute a part of this specification, illustrate an implementation of the invention and, together with the description, serve to explain the advantages and principles of the invention. In the drawings.

DETAILED DESCRIPTION OF THE INVENTION

Reference will now be made in detail to implementations consistent with the present invention as illustrated in the accompanying drawings. Wherever possible, the same reference numbers will be used throughout the drawings and the following description to refer to the same or like parts.

Figure 1:
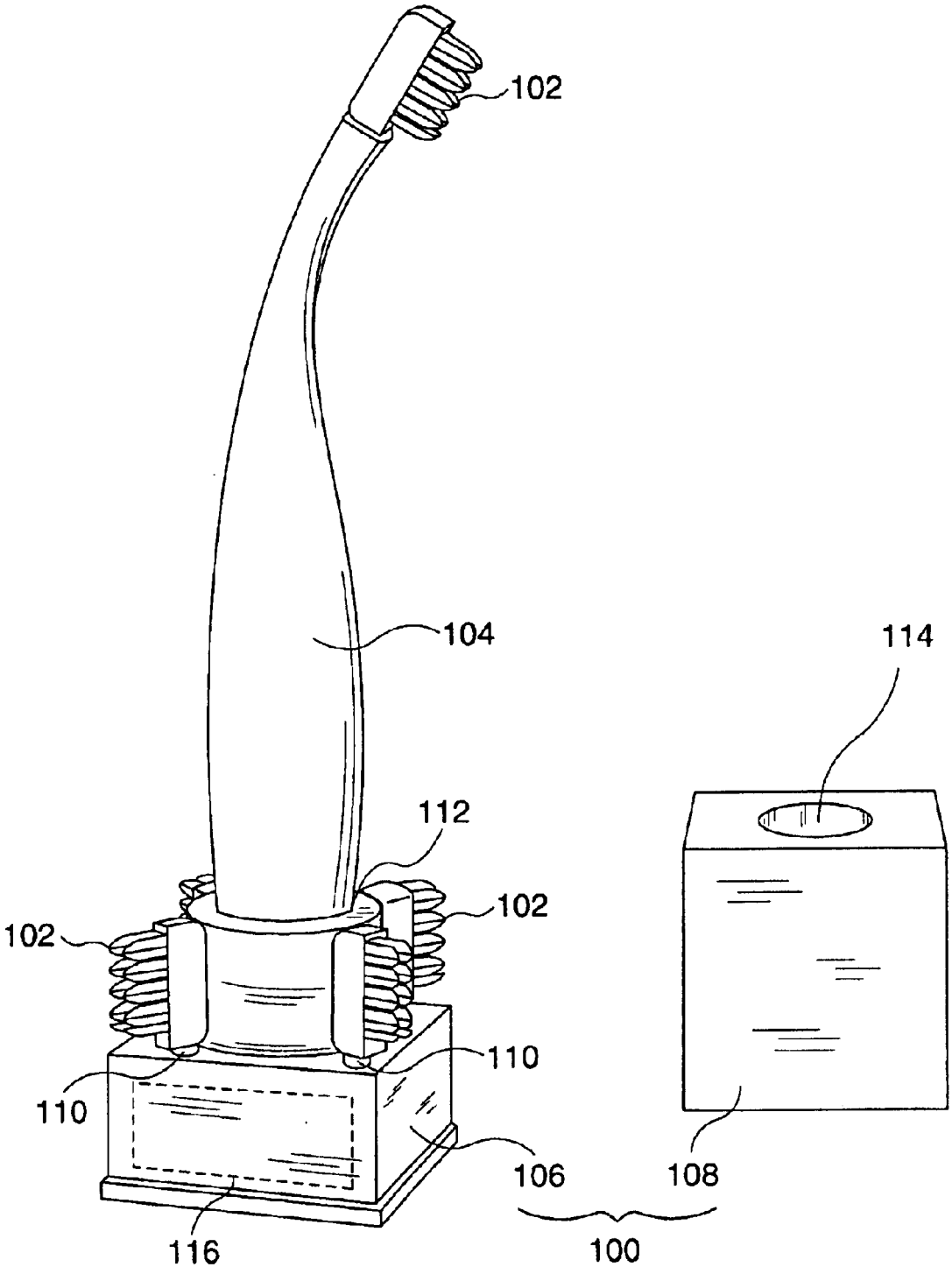
FIG. 1 depicts an electric toothbrush with attachments and a storage container for the attachments to the toothbrush in accordance with the present invention.

FIG. 1 depicts a storage container 100 for attachments 102 to a personal grooming tool 104. In this embodiment, the tool 104 is depicted as an electric toothbrush. The storage container 100 includes a housing 106 and a cover 108. The housing 106 includes supports 110 for the attachments 102 and a cavity 112 to support the tool 104. In this example, the supports 110 are depicted as prongs extending from the housing 106. One skilled in the art, however, will recognize that the supports may also be grooves or cavities formed within the housing 106. In the example of FIG. 1, the supports 110 are shown as being preferably implemented at the corners of a rectangular housing to take advantage of the space left by the substantially cylindrical cavity 112. In this way, the storage is compact and allows for better space utilization.

A charger 116 may be operably associated with the cavity 112. In which case, the cavity 112 may be designed to allow the charger 116 (where provided) to charge a battery (not shown) within the tool 104.

The cover 108 may be placed over the housing 106 to conceal the attachments 102, and includes an aperture 114 positioned to overlap the cavity 112 when the cover is placed on the housing 106. When the cover 108 is placed over the housing 106, the tool 104 fits through the aperture 114 to seat in cavity 112.

Figure 2:
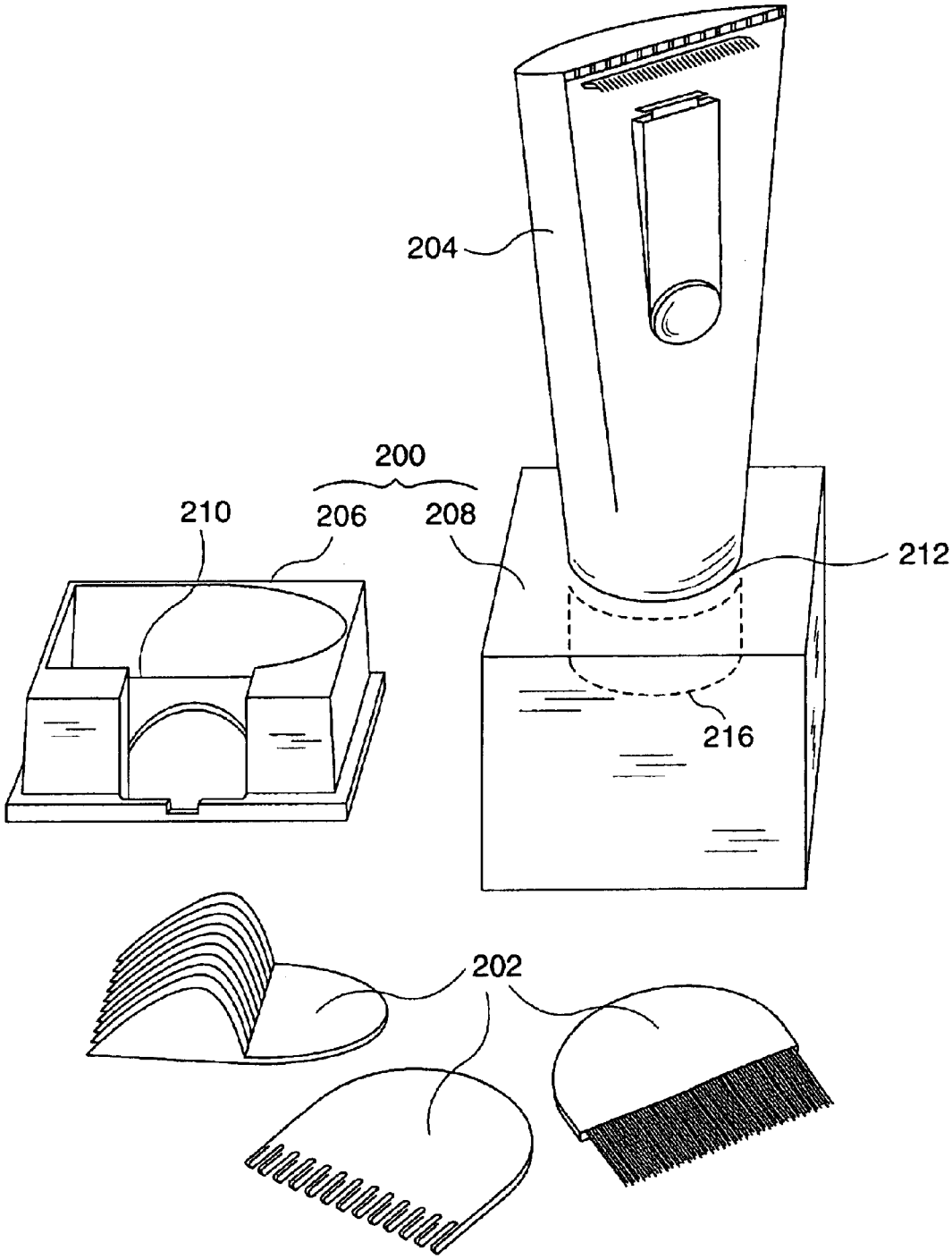
FIG. 2 depicts a beard trimmer with attachments and a storage container for the attachments to the beard trimmer in accordance with the present invention.
Figure 2A:
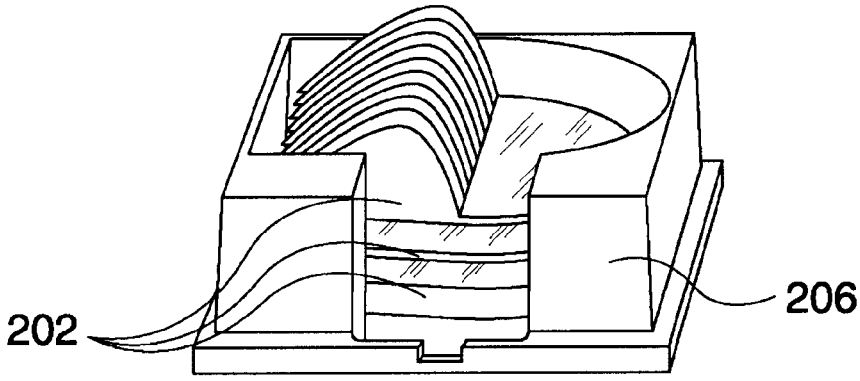
FIG. 2A depicts the storage container depicted in FIG. 2 with the beard trimmer attachments placed in the storage container.

FIG. 2 depicts another embodiment of a storage container 200 for attachments 202 to a personal grooming tool 204. In this embodiment, the tool 204 is depicted as a beard trimmer. The storage container 200 includes a housing 206 and a cover 208. The housing 206 includes a chamber 210 to accommodate the attachments 202. The cover 208 includes a cavity 212, and a charger (not shown) may be operably associated with the cavity 212. The cavity 212 is designed to support the tool 204 and to allow the charger (where provided) to charge a battery (not shown) within the tool 204. The cover 208 may be placed over the housing 206 to enclose the chamber 210 and conceal the attachments 202. In this example, attachments 202 are configured so as to mate compactly with chamber 210. In particular, the chamber 210 is shaped to conform to the shape of the attachments 202 so that the attachments 202 fit snugly within the chamber 210, as depicted in FIG. 2A. Also, the outer boundary of the housing 206 extends slightly beyond the chamber 210 to minimize the space utilized by the container 200.

Figure 3:
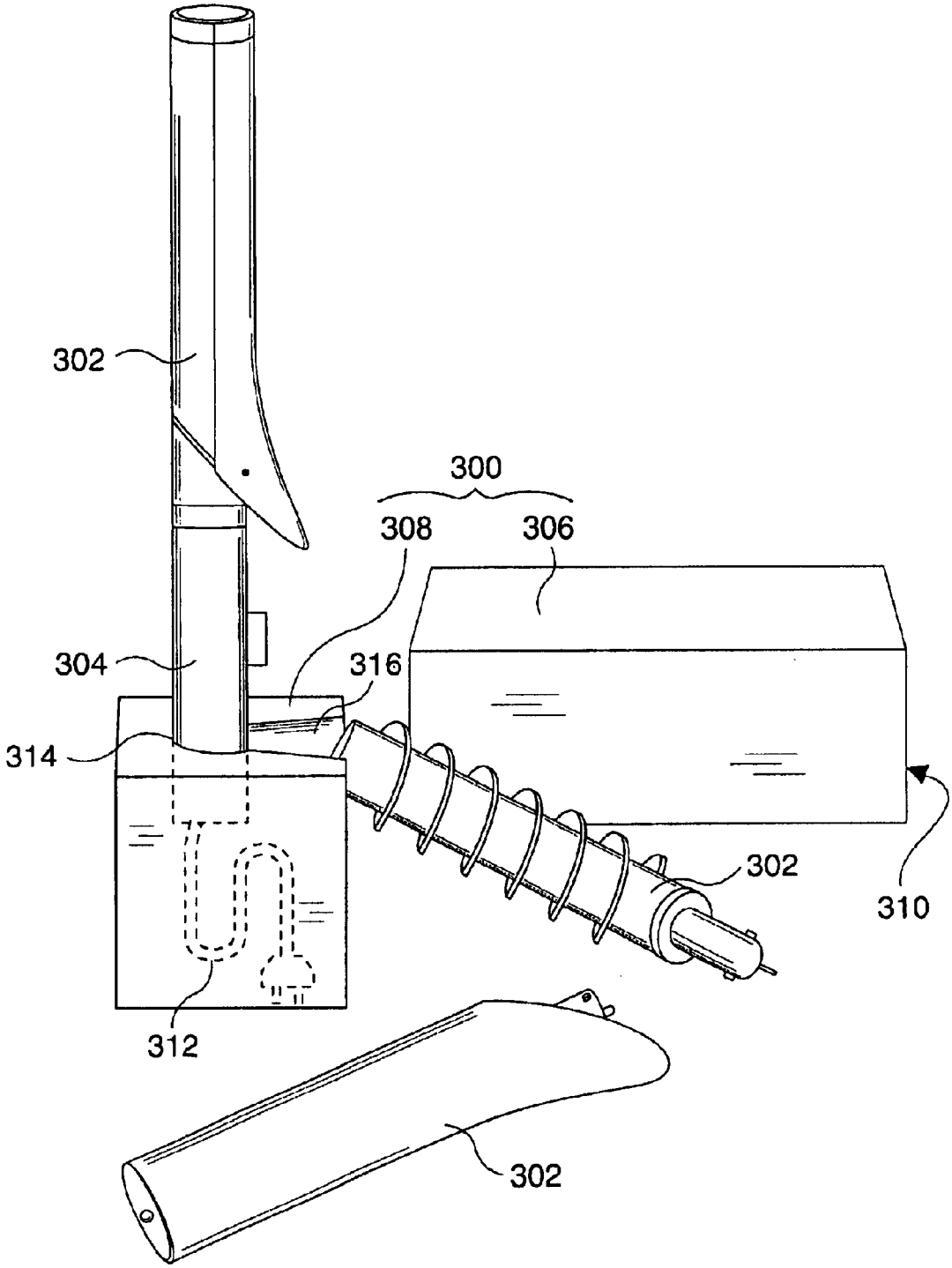
FIG. 3 depicts a curling iron with attachments and a storage container for the attachments to the curling iron in accordance with the present invention.
Figure 4:
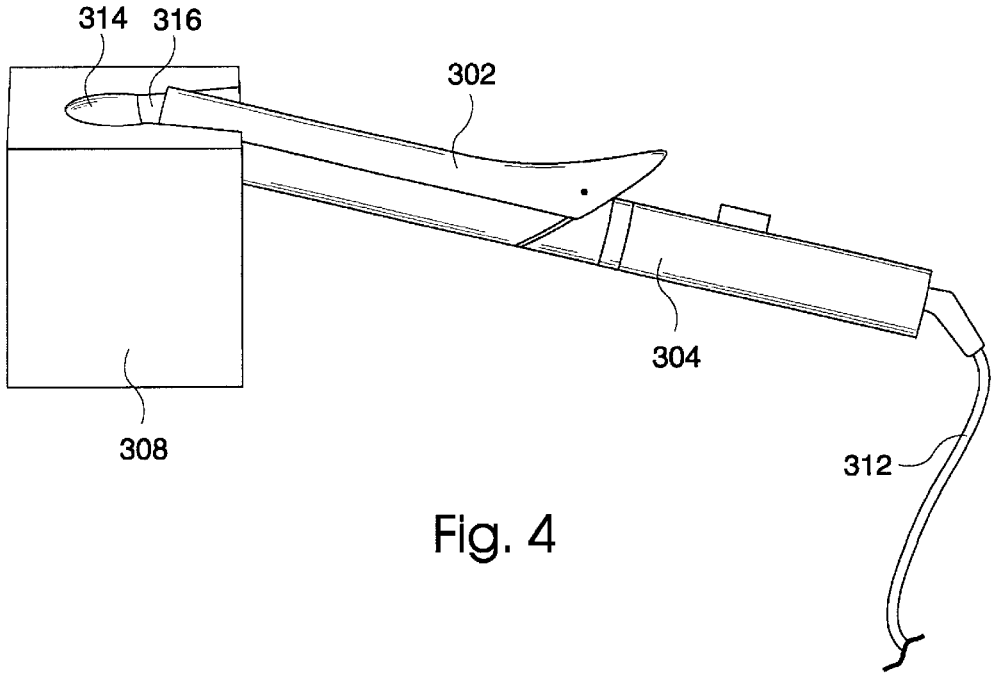
FIG. 4 depicts the storage container depicted in FIG. 3 used as a stand for the curling iron.

FIG. 3 depicts another embodiment of a storage container 300 for attachments 302 to a personal grooming tool 304. In this embodiment, the tool 304 is depicted as a curling iron. The storage container 300 includes a housing 306 and a cover 308. The housing 306 includes a chamber 310 to accommodate the attachments 302. An electric cord 312 (FIG. 4) is connected to the tool 304. The cover 308 includes a cavity 314 designed to support the tool 304, as shown in FIG. 3. The cavity 314 has an aperture (not shown) to allow the cord 312 on the tool 304 to extend through the cover 308. The cover 308 may be placed over the housing 306 to conceal the attachments 302 and the cord 312 in the chamber 310 of the housing 306. As depicted in FIG. 4, the cover 308 also includes a notch 316 adjacent to the cavity 314. The notch 316 is designed to support the attachment 302 on the tool 304 to prevent the attachment 302 from scorching a surface when the attachment 302 is heated.

Figure 5:
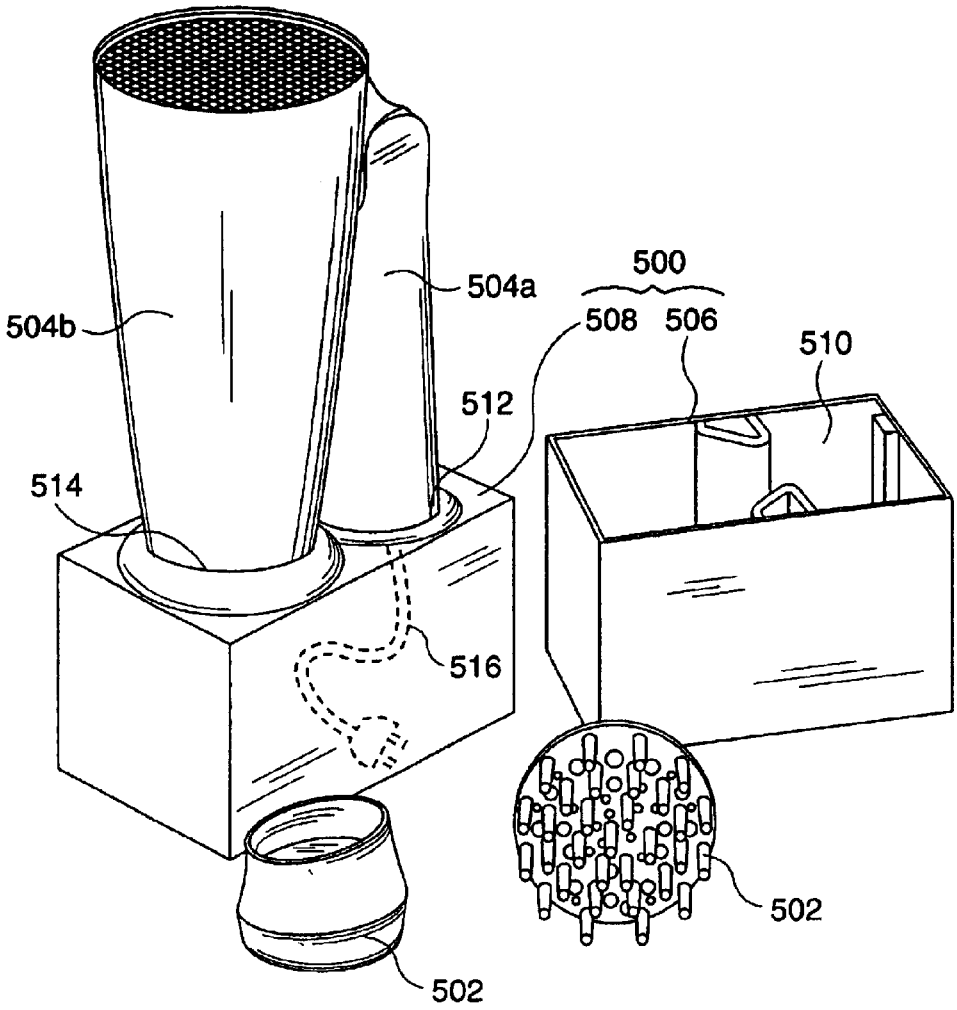
FIG. 5 depicts a hair dryer with attachments and a storage container for the attachments to the hair dryer in accordance with the present invention.

FIG. 5 depicts another embodiment of a storage container 500 for attachments 502 to a personal grooming tool 504. In this embodiment, the tool 504 is depicted as a hair dryer. As depicted in FIG. 5, the tool 504 folds for convenient storage between two portions of the tool 504, specifically a handle 504*a* and a head 504*b*.

Similar to the curling iron, the storage container 500 includes a housing 506 and a cover 508. The housing 506 includes a chamber 510 to accommodate the attachments 502 and an electric cord 516 connected to the handle 504*a* of the tool 504. The cover 508 includes two cavities 512 and 514 designed to support the handle 504*a* and the head 504*b* of the tool 504, respectively. The cavity 512 supporting the handle 504*a* also includes an aperture (not shown) to allow the cord 516 on the tool 504 to extend through the cover 508. The cover 508 may be placed over the housing 506 to conceal the attachments 502 and the cord 516 in the chamber 510 of the housing 506.

Although the storage containers disclosed above were depicted as a particular shape, i.e., rectangular, one skilled in the art will recognize that the storage container of the present invention may be formed in any shape, including cylindrical, triangular, pentagonal, hexagonal, etc. Thus, the storage containers consistent with the present invention are not limited to those used in the present embodiment.

While various embodiments of the present invention have been described, it will be apparent to those of skill in the art that many more embodiments and implementations are possible that are within the scope of this invention. Accordingly, the present invention is not to be restricted except in light of the attached claims and their equivalents.

What is claimed is:

1. A storage container, comprising:

a housing including:

a support for an attachment to a personal grooming tool;

a cavity designed to support the tool; and a cover configured to fit over the housing wherein the cover includes an aperture positioned to overlap the cavity when the cover is placed on the housing, and wherein the cavity supports the tool when the tool is placed through the aperture and extends above the aperture; and a charger operably associated with the cavity.

2. The storage container of claim 1, wherein the support comprises a prong extending from the housing.

3. The storage container of claim wherein the support comprises a groove formed in the housing.

4. The storage container of claim 1, wherein the housing includes a corner and wherein the support is implemented at the corner of the housing.

5. An article of manufacture, comprising:

a personal grooming tool;

an attachment connected to the personal grooming tool wherein the attachment is detachable from the personal grooming tool;

a housing including:

a support for the attachment; and a cavity designed to support the tool; and a cover configured to fit over the housing wherein the cover includes an aperture positioned to overlap the cavity when the cover is placed on the housing, and wherein the cavity supports the tool when the tool is placed through the aperture and extends above the aperture.

6. The article of claim 5, wherein the support comprises a prong extending from the housing.

7. The article of claim 5, wherein the support comprises a groove formed in the housing.

8. The article of claim 5, further comprising a charger operably associated with the cavity.

* * * * *